US005669725A

United States Patent [19]

Koshiishi et al.

[11] Patent Number: 5,669,725

[45] Date of Patent: *Sep. 23, 1997

[54] IMPACT DOT PRINTER WITH NOISE SUPPRESSION

[75] Inventors: Osamu Koshiishi; Shigeki Mizuno; Keiichi Kubota; Katsuhiko Nishizawa; Motoyuki Niimura; Hiroshi Shirotori; Kyoui Ko, all of Suwa, Japan

[73] Assignee: Seiko Epson Corporation, Tokyo, Japan

[ * ] Notice: The term of this patent shall not extend beyond the expiration date of Pat. No. 5,540,511.

[21] Appl. No.: 668,457

[22] Filed: Jun. 18, 1996

Related U.S. Application Data

[63] Continuation of Ser. No. 52,028, Apr. 22, 1993, Pat. No. 5,540,511.

[30] Foreign Application Priority Data

| | | | |
|---|---|---|---|
| Apr. 22, 1992 | [JP] | Japan | 4-26231 |
| Jun. 10, 1992 | [JP] | Japan | 4-159429 |
| Jun. 17, 1992 | [JP] | Japan | 4-41614 |
| Jun. 18, 1992 | [JP] | Japan | 4-159426 |
| Jun. 18, 1992 | [JP] | Japan | 4-159427 |
| Jun. 18, 1992 | [JP] | Japan | 4-159428 |

[51] Int. Cl.[6] ..... B41J 29/08

[52] U.S. Cl. ..... 400/690; 400/689; 400/642

[58] Field of Search ..... 400/644, 445, 400/645.4, 646, 647, 648, 689, 690, 690.1, 690.2, 690.3, 690.4, 691, 692, 693

[56] References Cited

U.S. PATENT DOCUMENTS

| | | | |
|---|---|---|---|
| 3,122,228 | 2/1964 | Dollenmayer et al. | 400/690 |
| 4,813,800 | 3/1989 | Hasegawa et al. | 400/618 |
| 4,943,173 | 7/1990 | Okazaki et al. | 400/689 |
| 5,033,892 | 7/1991 | Fujii et al. | 400/691 |
| 5,040,912 | 8/1991 | Koizumi et al. | 400/689 |
| 5,158,378 | 10/1992 | Takaoa et al. | 400/124 |
| 5,207,521 | 5/1993 | Ricca et al. | 400/690 X |
| 5,244,295 | 9/1993 | Terashima et al. | 400/639 |

FOREIGN PATENT DOCUMENTS

| | | |
|---|---|---|
| 0 038 065 | 10/1981 | European Pat. Off. . |
| 0 384 576 | 8/1990 | European Pat. Off. . |
| 0 454 412 | 10/1991 | European Pat. Off. . |
| 3403838 | 8/1984 | Germany . |
| 56-155779 | 12/1981 | Japan . |
| 60-73881 | 4/1985 | Japan . |
| 64-48263 | 3/1989 | Japan . |
| 2-52776 | 2/1990 | Japan . |
| 4-22661 | 1/1992 | Japan . |
| 4-27577 | 1/1992 | Japan . |
| 4-47975 | 2/1992 | Japan . |
| 2203700 | 10/1988 | United Kingdom . |

*Primary Examiner*—Christopher A. Bennett

*Attorney, Agent, or Firm*—Stroock & Stroock & Lavan LLP

[57] ABSTRACT

An impact dot printer designed to reduce noise, including a first cover, a second cover, and an overlap portion therebetween. The first cover is located above a print section, and may include sound wave reflecting plates, sheet guide plates, and a sound absorbing member, each reflecting plate, each sheet guide plate, and the sound absorbing member being arranged close to the print section. The second cover is rotatable relative to the first cover and forms a printed sheet discharge path together with the first cover. The second cover also has sound wave reflecting plates and sheet guide plates. Each sheet guide plate is designed to be projected farther from the associated cover than the corresponding reflecting plate on said cover. The distance between adjacent sheet guide plates is made smaller than the width of the smallest sheet to be used in the printer. The overlap portion between the first and second covers is arranged so that essentially no opening is provided between the first and second covers when viewed from the top or side.

23 Claims, 10 Drawing Sheets

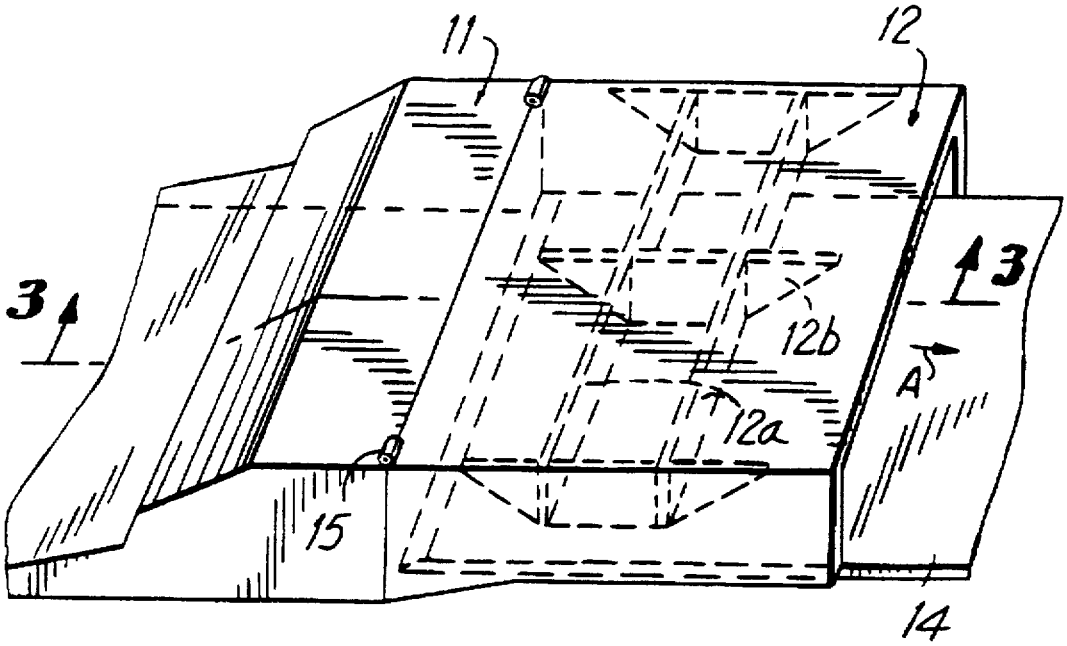
FIG. 2
PRIOR ART
FIG. 3
PRIOR ART
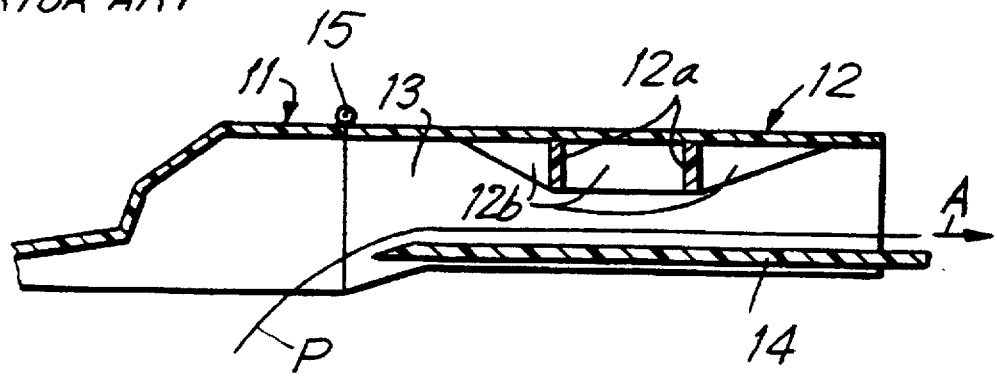

IMPACT DOT PRINTER WITH NOISE SUPPRESSION

CROSS-REFERENCE TO RELATED APPLICATIONS

This is a continuation application based on application Ser. No. 08/052,028 filed on Apr. 22, 1993, now U.S. Pat. No. 5,540,511.

BACKGROUND OF THE INVENTION

The present invention relates generally to impact dot printers, and, in particular, to reducing the noise produced thereof.

Generally, impact dot printers are designed to print by driving print wires which are built into the print head so that the ends of the print wires impact a sheet of paper through an ink ribbon. However, a drawback that is frequently encountered in such impact dot printers is excess noise emanating from the resulting collision of the print wires with the sheet of paper. Such noise leaks out of the printer from the sheet discharge section, thereby ultimately increasing the noise level of the printer.

Japanese Utility Model Unexamined Publication No. 64-48263 discloses one way in which noise is reduced from such a impact dot printer. The construction thereof is described with reference to FIGS. 1–5.

FIG. 1 depicts the exterior of a typical impact dot printer, with reference numeral 10 designating generally a printer case. Inside printer case 10, although not shown in the figure, is a print head, a platen, and the like. A sheet discharge section above printer case 10 is covered by a first cover 11 and a second cover 12. As shown in FIG. 3, a sheet discharge path 13 for a printed sheet of paper P is formed by first cover 11 and second cover 12.

As shown in FIGS. 2 and 3, inside second cover 12 are reflecting plates **12*a* for reflecting sound waves and a sheet guide plate 12*b* for guiding the printed sheet P. Each reflecting plate 12*a* extends in a direction orthogonal to a sheet forward direction A. The reflecting plates 12*a* are arranged to partially change the cross-sectional area of sheet discharge path 13, so that by reflecting the sound wave propagated through sheet discharge path 13 by reflecting plates 12*a***, the noise level can be reduced.

In FIGS. 1–5, sheet guide 14 guides the discharged printed sheet (which can be separate cut sheets or a continuous length of tractor-fed computer paper) after printing thereon. Second cover 12 covers a large portion of the top of sheet guide 14. Sheet guide 14 is mounted so as to be pivotable relative to printer case 10. To print on a cut sheet (not shown), sheet guide 14 is pivoted upwardly as shown in FIG. 4, so that a cut sheet can be supplied to the print section along the plane created by pivoted sheet guide 14. Second cover 12 is also joined to first cover 11 by pivoting support sections 15 (see FIG. 1) for pivoting relative to first cover 11, such that second cover 12 can be pivoted together with sheet guide 14 when sheet guide 14 is pivoted.

The conventional printers employing the structures described above have the following problems.

First, reflecting plates **12*a* are arranged only on second cover 12, which results in an insufficient noise reduction because reflecting plates 12*a*** are not located sufficiently close to the print head and to the platen, which are the major sources of noise.

Second, reflecting plates **12*a* and sheet guide plate 12*b* have the same height, as shown in FIG. 3, frequently causing the front end of a printed sheet to easily jam. This jamming is a frequent problem particularly with narrow sheets of paper. Although a solution to this jamming problem may be to design sheet discharge path 13 so that it has a greater height, by doing so will also increase the noise because the cross-sectional area of sheet discharge path 13** increases.

Third, as shown in FIG. 4, when sheet guide 14 is pivoted to be able to print on a cut sheet, an opening S1 is provided between side plates **11*c* of first cover 11 and side plates 12*c* of second cover 12, causing an excessive amount of noise to leak from opening S1. Similarly, as shown in FIG. 5, an opening S2 is provided between the rear edge of a top plate 11*d* of first cover 11 and a top plate 12*d* of second cover 12**, which also allows noise to leak from such opening S2.

Accordingly, it is desired to provide an improved impact dot printer having a construction which will operate with a reduced noise level.

SUMMARY OF THE INVENTION

Generally speaking, in accordance with the present invention, an impact dot printer is provided including a print section formed of a platen, a print head which confronts the platen, and a silencing device disposed above the print section.

The silencing device according to this invention has either a reflecting plate for reflecting a sound wave, the reflecting plate extending in a direction orthogonal to the sheet forward direction, or a sound absorbing member for absorbing sound. The silencing device may also have a reinforcing plate which serves as a sheet guide for guiding a printed sheet, the reinforcing plate being a plate-like body and intersecting the reflecting plate. By arranging a sheet discharge plate for guiding a printed sheet between the platen and the silencing means, the silencing means can be disposed closer to the platen. Further, by making the reinforcing plate higher than the reflecting plate, the silencing means can be put closer to the print section without involving the sheet discharge plate. The distance between a plurality of reinforcing plates serving as sheet guide plates is preferably smaller than the width of a minimum sheet size to be supplied for printing, thereby preventing paper jamming.

An impact dot printer in accordance with the invention includes a printer case. Inside the printer case there is at least a platen and a print head. The impact dot printer also has a first cover for covering the top of the printer case, the first cover having a top plate and side plates formed integrally with the top plate. Rotatably mounted on the first cover is a second cover, the second cover having a top plate and side plates formed integrally with the top plate. There is also an overlap portion between the side plates of the first cover and the side plates of the second cover so that there is no opening between the side plates of the first cover and the side plates of the second cover when the second cover is pivoted relative to the first cover. This overlap portion is formed from a fan-like overlap strip formed on the ends of the side plates of one of the first cover or the second cover, which overlaps the side plates of the other cover.

Further, a second overlap portion is disposed between the top plates of the first cover and the second cover so that no opening is formed along the axial line of the turning section between the first cover and the second cover when the second cover is rotated relative to the first cover. This second overlap portion can be formed by an arcuate surface corresponding to a locus formed by turning a front end of one of the first cover or the second cover, relative to the other cover, the front end being on the side of the center of turning.

The second cover is formed so as to rotate above the first cover, and a cutter for cutting a sheet may be arranged on an edge of the first cover, the edge being exposed when the second cover is rotated above the first cover. The first cover and the second cover are designed so as to form an upper portion of a sheet discharge path. In this case, it is desirable to arrange a similar silencing means having a reflecting plate and a sheet guide plate also on the second cover.

Accordingly, it is an object of the present invention to provide an improved impact dot printer.

Another object of the present invention is to provide an impact dot printer having an construction that will operate at a reduced noise level.

Another object of the present invention is to provide an impact dot printer having a construction that prevents paper from jamming in the sheet discharge section thereof.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is an enlarged fragmentary perspective view of the covers of the printer of FIG. 1 constructed in accordance with the prior art;

FIG. 3 is a sectional view taken along a line 3—3 in FIG. 2;

DETAILED DESCRIPTION OF THE PREFERRED EMBODIMENTS

Figure 6:
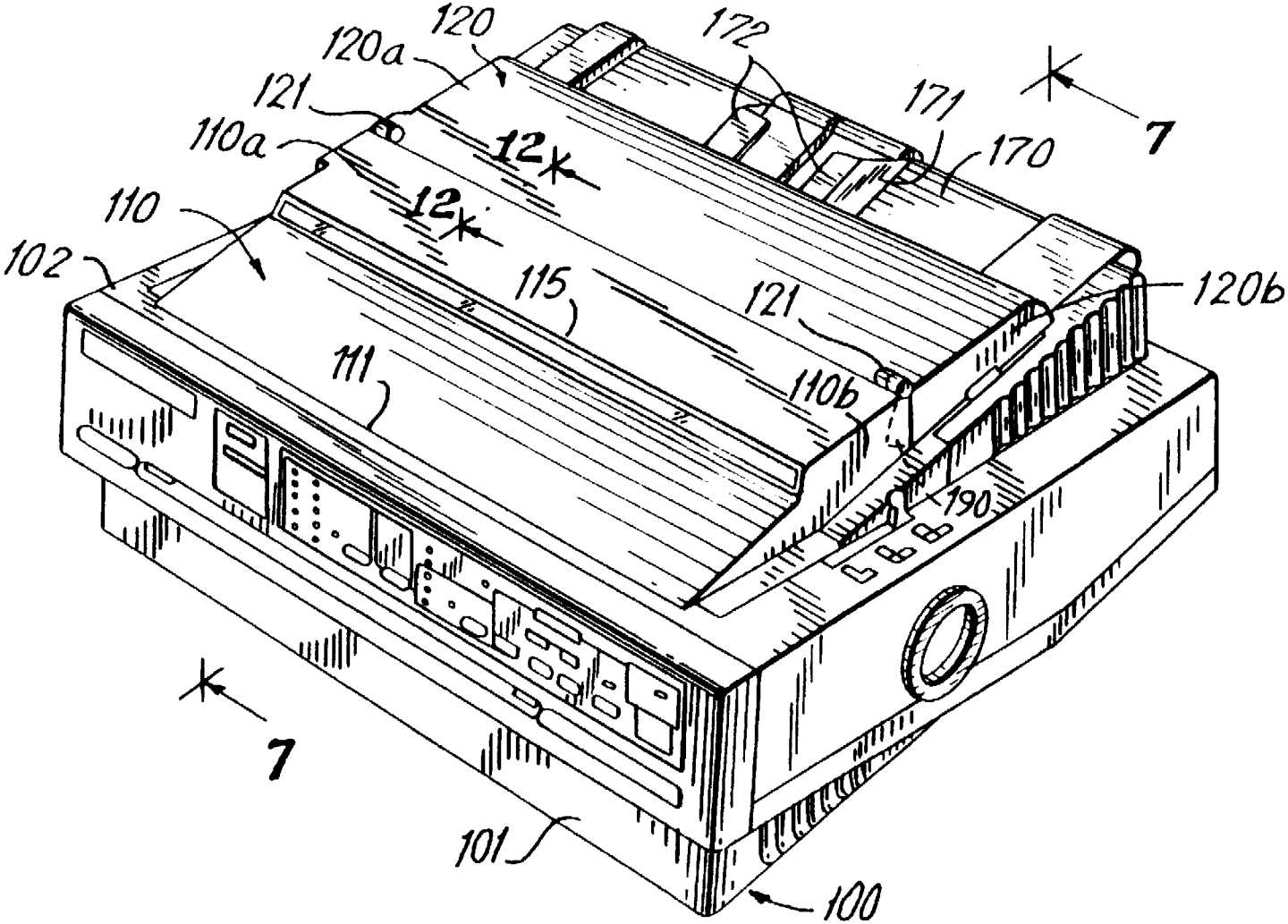
FIG. 6 is a perspective view showing the external aspects of an impact dot printer in accordance with a first embodiment of the invention.
Figure 7:
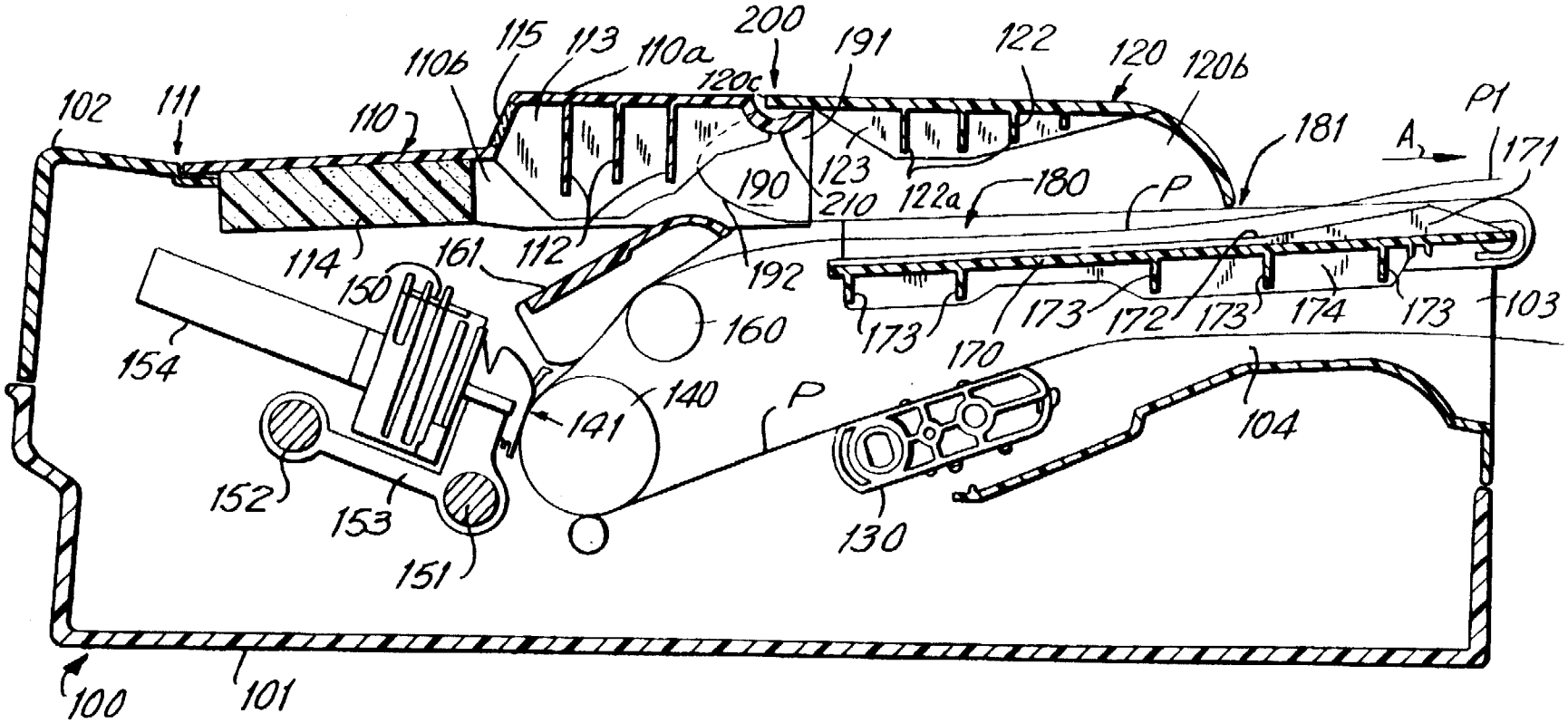
FIG. 7 is a sectional view taken along lines 7—7 of FIG. 6.

Reference is first made to FIGS. 6 and 7 of the drawings which depict a printer case generally indicated at 100, constructed in accordance with a first embodiment of the present invention, having a lower case 101 and an upper case 102.

As seen in FIG. 7, tractor 130 forwards a continuous sheet P fed through a sheet feed path 104 from sheet feed inlet 103 to a platen 140. The sheet P forwarded by tractor 130 is wound on to platen 140, and is thereafter printed on at a print section 141 between platen 140 and print head 150.

Print head 150 is an impact dot head having a plurality of built-in wires (not shown). Print head 150 is mounted on a carriage 153 that shuttles in a direction parallel to the sheet surface while being guided by guide shafts 151, 152. Printing is done by means of said wires that are driven and come out at predetermined times to form dots on the sheet through an ink ribbon (not shown) in association with the shuttling of carriage 153. The ink ribbon is supplied between the sheet P and the head 150 from an ink ribbon cartridge 154.

The printed sheet P receives sheet discharge force from a sheet discharge roller 160 as the sheet P is being guided by a sheet discharge plate 161, and passes through a sheet discharge path 180 guided by a sheet guide 170, and is discharged outside the printer from a sheet discharge outlet 181 in the direction of arrow A.

The top of printer case 100 carries a first cover 110 and a second cover 120. Sheet discharge path 180 is formed primarily from the area between second cover 120 and sheet guide 170.

First cover 110, made of thermoplastic material, has a top plate **110*a* and side plates 110*b*. Side plates 110*b* are formed integrally with top plate 110*a* and are located above print section 141. First cover 110 is pivotally mounted on upper case 102 at a front end 111 thereof so that ink ribbon cartridge 154 can be replaced easily. Inside first cover 110 is a silencing means located at the closest possible position relative to print section 141**.

Figure 8:
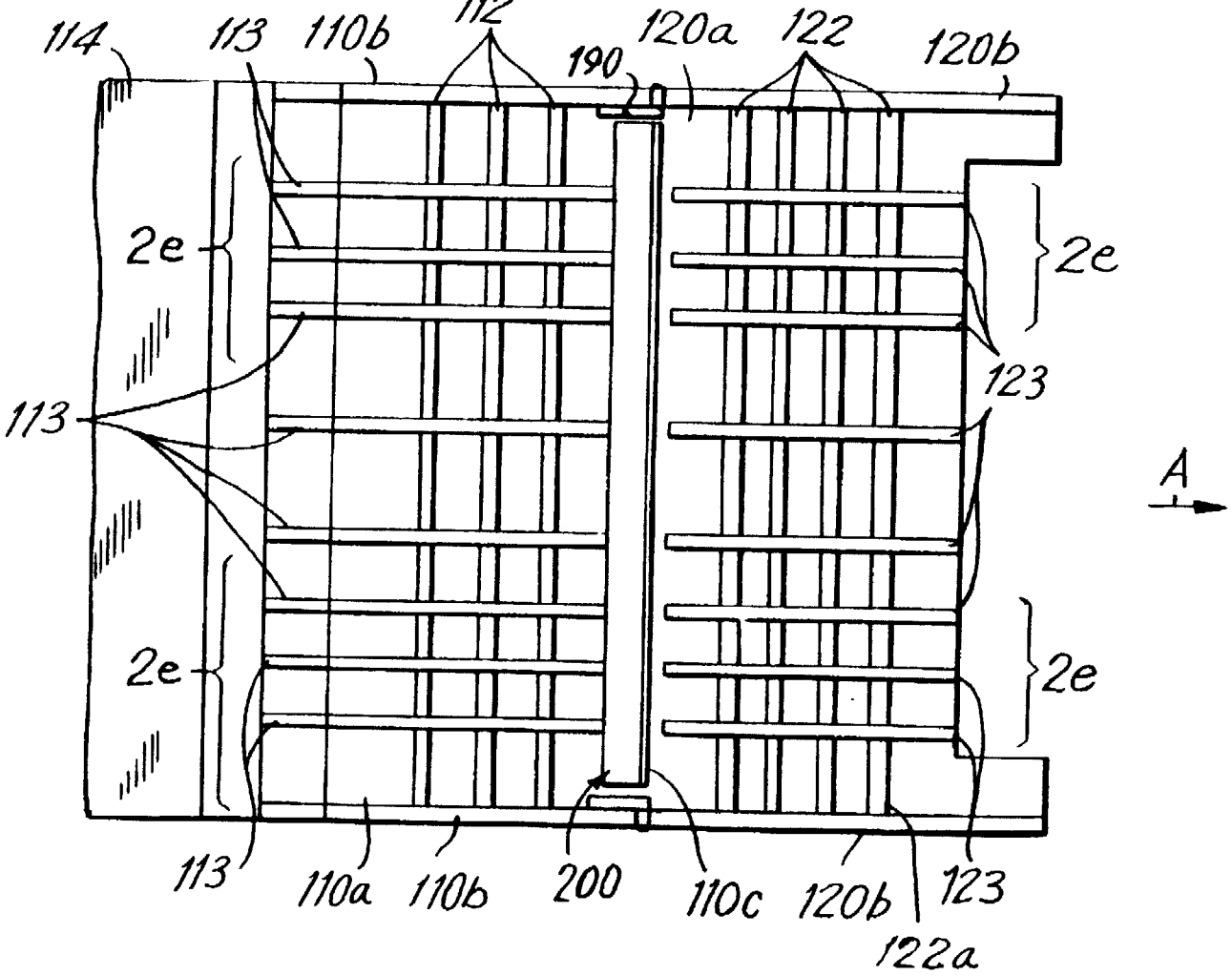
FIG. 8 is a bottom view of a first cover and a second cover of the printer of FIGS. 6 and 7.

The silencing means includes reflecting plates 112, reinforcing plates 113, and a sound absorbing member 114. Each reflecting plate 112 extends in a direction orthogonal to a sheet forward direction A. Each reinforcing plate 113 extends in a direction orthogonal to reflecting plates 112, as shown in FIG. 8. Each reflecting plate 112 and each reinforcing plate 113 are formed integrally with first cover 110. Sound absorbing member 114 is formed of a foam plastic or rubber, and is fixed on first cover 110 by an adhesive or the like. While a large component such as first cover 110 is often subjected to creep and causes trouble when it comes in contact with other components when the printer has been used for a long time, first cover 110 employed in this embodiment is free from such trouble because first cover 110 is reinforced by reinforcing plates 113.

An inclined portion 115 of first cover 110 is made of a transparent member, and sound absorbing member 114 is located slightly apart from inclined portion 115. This construction contributes to allowing the user to take a look at the printed result immediately after printing.

To enable the user to view the printed result through inclined portion 115, at least a portion of sheet discharge plate 161 is formed of a transparent material.

Figure 9:
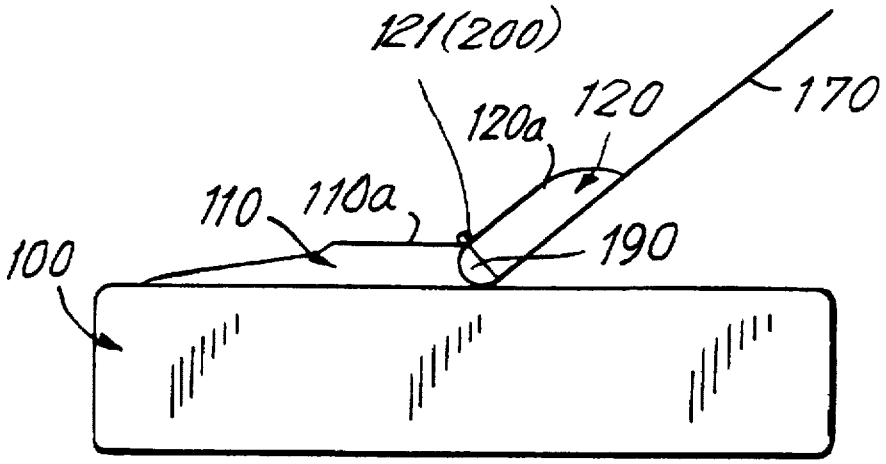
FIG. 9 is a schematic side elevational view showing a printer with the sheet guide and second cover pivoted relative to the first cover.

Second cover 120, made of thermoplastic material, has a top plate 120*a* and side plates 120*b*, side plates 120*b* are formed integrally with top plate 120*a*, and covers most of sheet guide 170. Sheet guide 170 is pivotally mounted on printer case 100. To print on a cut sheet (not shown), sheet guide 170 is pivoted upward, as shown in FIG. 9, to allow the cut sheet to be fed to platen 140 along sheet guide 170. Second cover 120 is pivotally mounted on first cover 110 through pivot support sections 121, (see also FIG. 6), and can pivot together with sheet guide 170 when sheet guide 170 is pivoted upwardly.

An overlap portion 190 is arranged between side plates 110*b* of first cover 110 and side plates 120*b* of second cover 120, for preventing an opening from forming between the side plates of the first cover and those of the second cover when second cover 120 is pivoted relative to first cover 110 in the above-described way.

Figure 10:
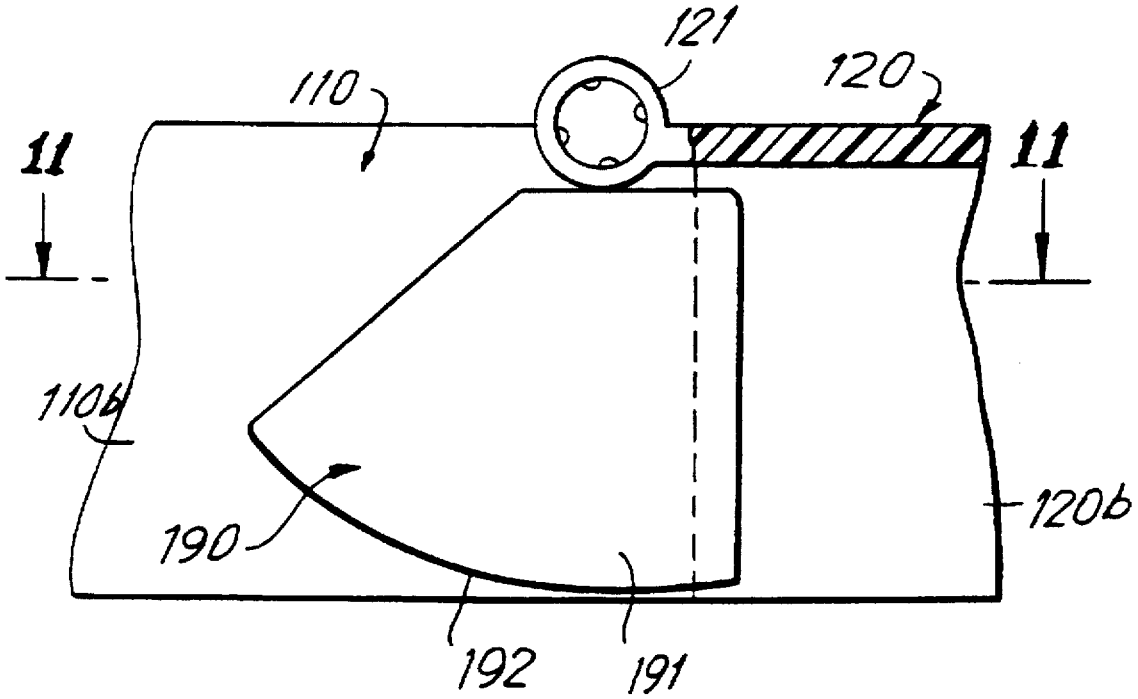
FIG. 10 is an enlarged fragmentary sectional view of the pivot construction in accordance with the present invention.
Figure 11:
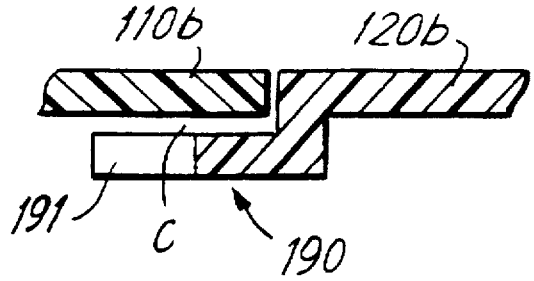
FIG. 11 is a fragmentary sectional view taken along lines 11—11 of FIG. 10.

As shown in FIGS. 7, 10, and 11, overlap portion 190 is formed of a fan-like overlap strip 191 formed integrally with a front end of each side plate 120*b* of second cover 120, which overlaps the corresponding side plate 110*b* of first cover 110 while defining a small gap c between side plate 110*b* and overlap portion 190, as shown in FIG. 11. An arcuate portion 192 of overlap strip 191 has the largest arc possible without interfering with printer case 100 when second cover 120 is placed in a horizontal position (see FIG. 7) or an inclined position (see FIG. 9).

Figure 12:
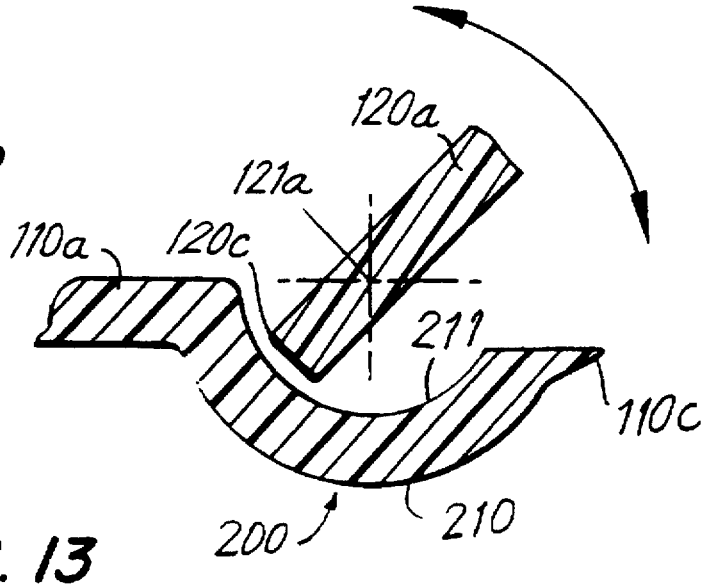
FIG. 12 is an enlarged fragmentary sectional view taken along lines 12—12 of FIG. 6.

As shown in FIGS. 7 and 12, between top plate 110*a* of first cover 110 and top plate 120*a* of second cover 120 is a second overlap portion, generally indicated at 200. Second overlap portion 200 is designed to prevent an opening extending along an axial line 121*a* of the pivoting section from forming between top plate 110*a* of first cover 110 and top plate 120*a* of second cover 120 when second cover 120 pivots relative to first cover 110.

As shown in FIGS. 7, 8, and 12 overlap portion 200 is formed by making the rear end of top plate 110*a* of first cover 110 in a semi-cylindrical form (the semi-cylindrical portion is designated by reference numeral 210) around a turning axial line 121*a* of second cover 120 at a lower portion thereof. Semi-cylindrical portion 210 is formed so that an arcuate surface 211 thereof has a form corresponding to a locus formed by turning a front end portion 120*c* of top plate 120*a* of second cover 120. The rear edge portion of first cover 110, which is exposed when second cover 120 has rotated above first cover 110, is a tear bar 110*c* for cutting a continuous sheet, as shown in FIG. 12.

Second cover 120 also has a silencing means inside the above-described top plate thereof. As shown in FIGS. 7 and 8, the silencing means includes reflecting plates 122 and sheet guide plates 123. Reflecting plates 122 are for reflecting a sound wave. Each reflecting plate extends and is orthogonal to sheet forward direction A and each sheet guide plate 123 intersects and is orthogonal to each reflecting plate 122. Each sheet guide plate 123 also serves as a reinforcing plate. Reflecting plate 122 and sheet guide plate 123 are formed integrally with second cover 120, with sheet guide plate 123 being higher relative to top plate 120*a* than reflecting plate 122. The distance between sheet guide plates 123 is smaller than the width of the smallest sheet size supplied to the printer. The distance between sheet guide plates 123 at positions 2*e* of FIG. 8, closer to the periphery of second cover 120 and therefore in registration with the corner widths of typical paper, are even closer together than those sheet guide plates in the middle of the printer, as shown in FIG. 8.

Two guide plates 171 for guiding paper sheet P are mounted on the upper surface of sheet guide 170. There is a guide surface 172 on each of the guide plates 171. The guide plates 171 and corresponding guide surfaces 172 can each be formed from a bent sheet material or from a single molded piece. Guide plates 171 and guide surface 172 are laterally displaceable along sheet guide 170 for positioning in registration with the printed paper P. The height of guide plates 171 increases as they approach sheet discharge outlet 181. As a result of this construction, the front end P1 of sheet P floats up when sheet P is being discharged from sheet discharge cutlet 181, thereby facilitating the ability to manually pick up the sheet P, which will come to rest on guide surface 172. Further, on the back of sheet guide 170 are a plurality of reflecting plates 173 for reflecting sound waves joined and supported by a plurality of sheet guide plates 174 which define the upper side of sheet feed path 104. Each reflecting plate extends in the direction orthogonal to sheet forward direction A.

In accordance with the first embodiment, sheet guide 170 is oriented in a horizontal position (see FIG. 7) when printing on a continuous sheet, and when printing on a cut sheet, sheet guide 170 is pivoted in an upward direction (see FIG. 9). The construction of the first embodiment in accordance with the invention has the following advantages.

Noise associated with printers of this type is primarily produced when the print wires arranged in print head 150 collide with platen 140 through the ink ribbon and sheet P, and also when a member for driving the print wires inside print head 150 collides within print head 150. A significant portion of the noise is produced at the location of print head 150 and platen 140 (i.e., around print section 141). Thus, it is advantageous to remove noise at positions close to print head 150 and platen 140, and also to attenuate the sound wave discharged from the opening of the printer at sheet discharge outlet 181.

Therefore, in accordance with the invention, part of the noise energy produced at print head 150 and platen 140 is absorbed by sound absorbing member 114 which is arranged below first cover 110, while much of the remainder of the noise is silenced in the course of being radiated out of sheet discharge outlet 181 through sheet discharge path 180, which is formed between sheet P and first and second covers 110, 120. Particularly, because print head 150 and platen 140 are a major contributor to the sources a noise, arranging a plurality of reflecting plates 112 above and as close to print head 150 and platen 140 as possible will contribute to an effective elimination of excess noise. Reflection of the sound wave, if any part of the section of a propagating path thereof undergoes a change, takes place with a particle velocity of the medium being discontinued at such part. Such reflection of the sound wave grows larger with a larger change of the section. Since reflecting plates 112 of first cover 110 jut out toward sheet discharge path 180 further than reflecting plates 122 of second cover 120, the sound eliminating effect of the first cover is larger. Further, with the sound wave repetitively reflected by reflecting plates 112 and 122 arranged on first cover 110 and second cover 120, respectively, the energy of the sound wave becomes attenuated, reducing the energy of the sound wave radiated from sheet discharge outlet 181. As a result, the noise level of the printer is reduced.

Since the sound wave is also reflected by reflecting plates 173 arranged below sheet guide 170, the noise radiated from sheet feed inlet 103 through sheet feed path 104 formed between sheetguide 170 and upper case 102 can also be reduced.

Figure 13:
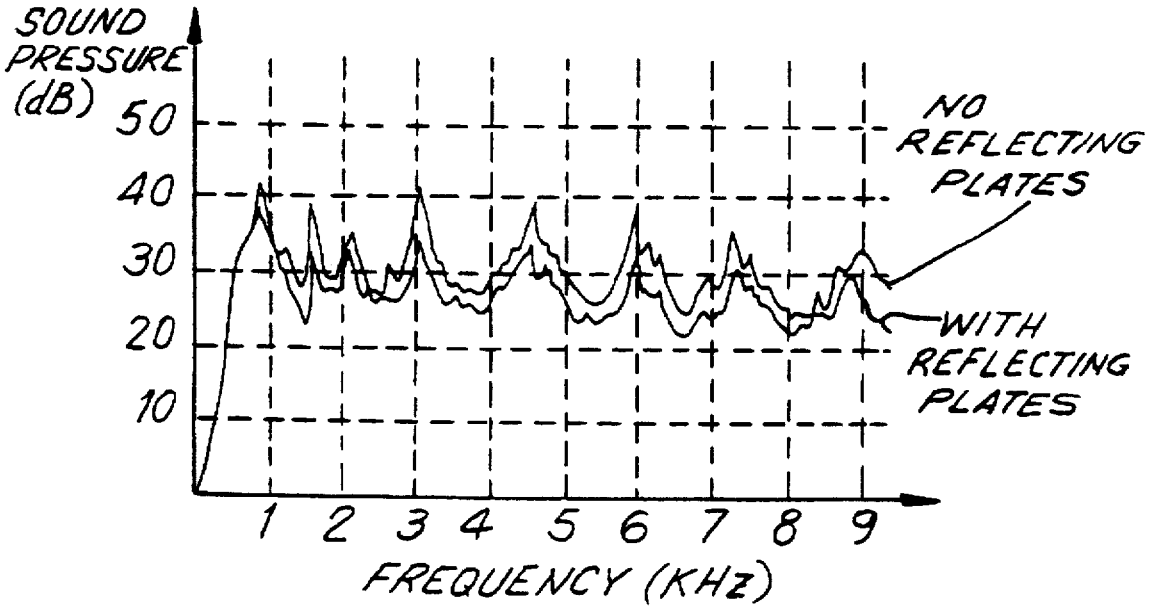
FIG. 13 is a graph showing the noise spectra both in the presence and in the absence of reflecting plates on the first and second covers.

FIG. 13 shows sound spectra in the presence and in the absence of reflecting plates 112 and 122 arranged on first cover 110 and second cover 120, respectively. Sound waves having frequencies equal to or greater than 1 kHz can be effectively attenuated in the first embodiment of FIGS. 6–11. Since the frequency of noise produced at print head 150 and platen 140 is primarily equal to or greater than 1 kHz, much of the sound can be effectively attenuated. Moreover, since noise that is offensive to the ear is in a frequency range above 1 kHz, the advantage obtained by this embodiment is larger in aural terms than the actual noise attenuation.

Figure 1:
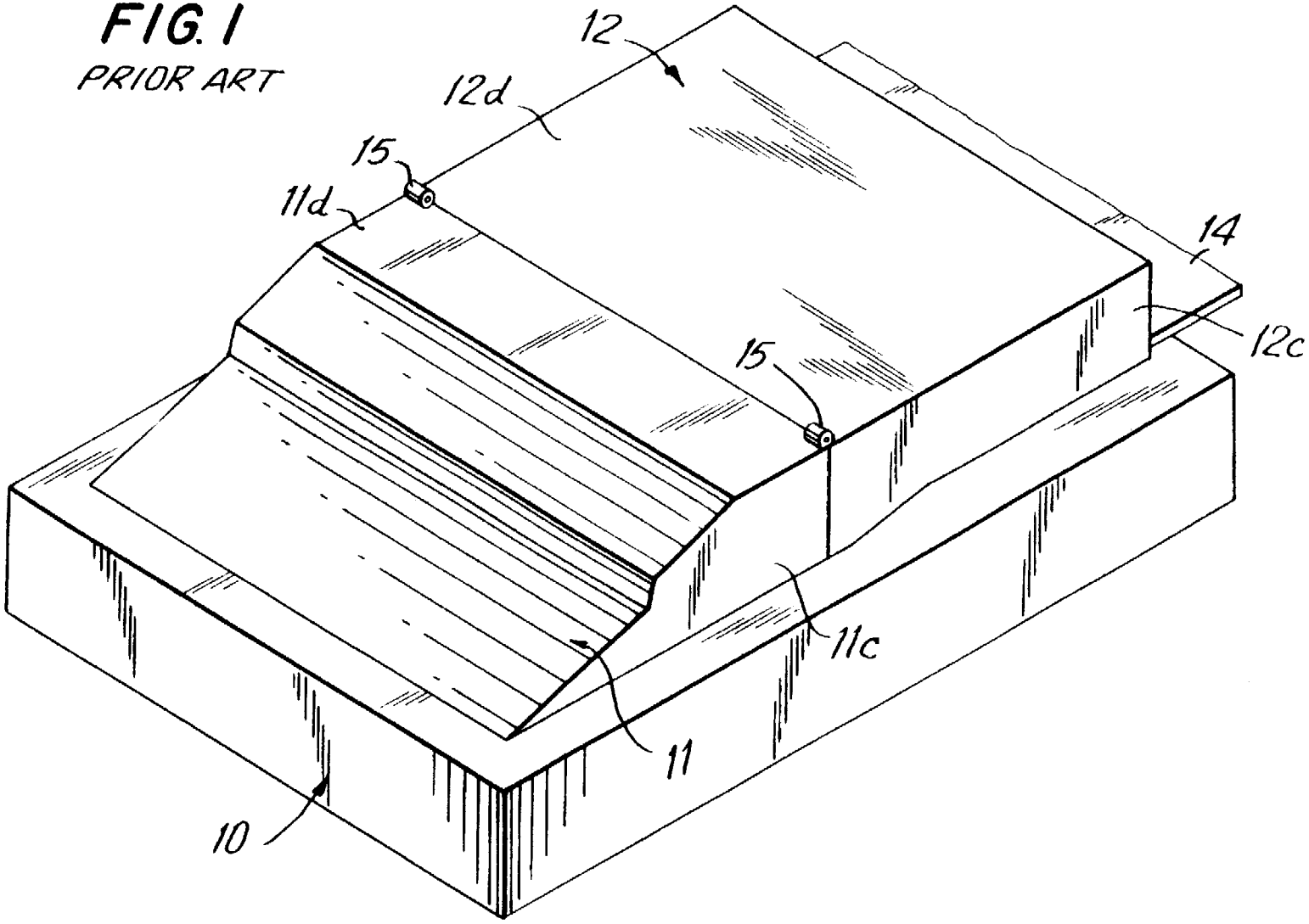
FIG. 1 PRIOR ART
FIG. 1 is a perspective view of a printer constructed in accordance with the prior art.
Figure 4:
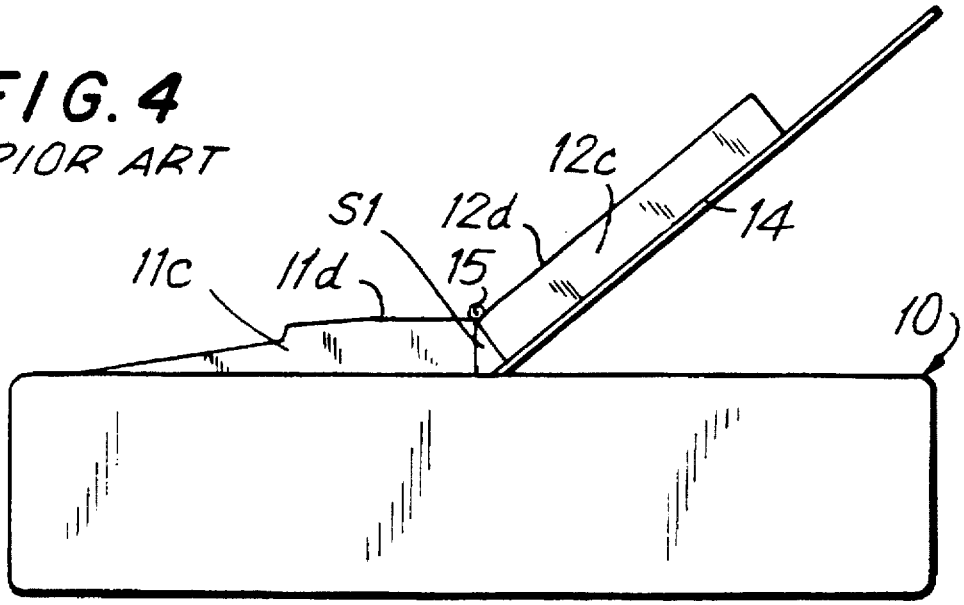
FIG. 4 PRIOR ART
FIG. 4 is a schematic side elevational view showing a conventional printer in accordance with the prior art with a pivoted sheet guide and second cover.
Figure 5:
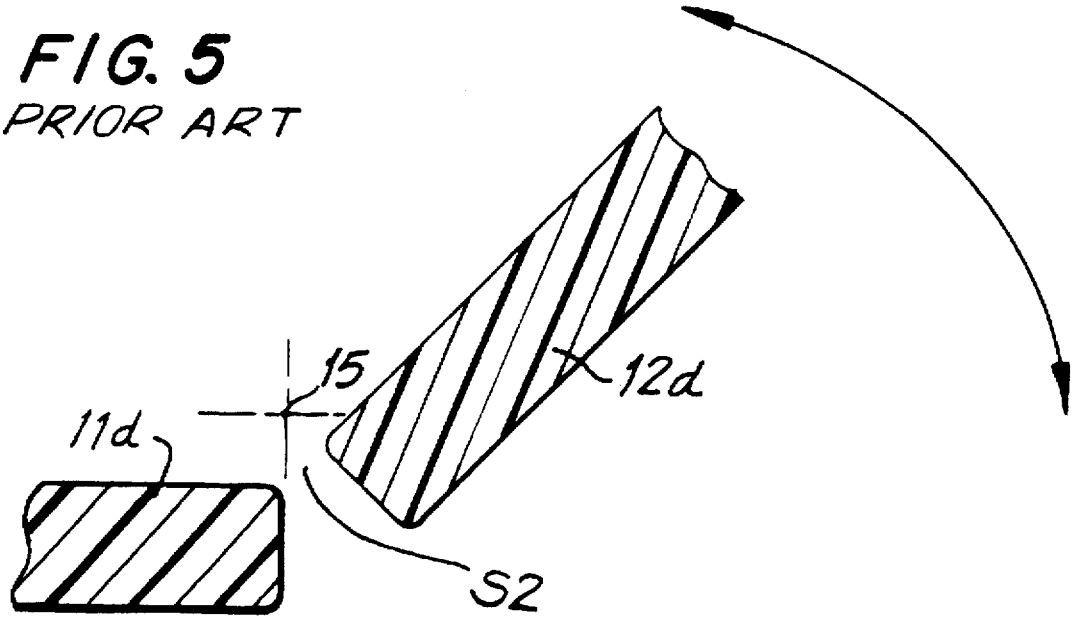
FIG. 5 PRIOR ART
FIG. 5 is an enlarged fragmentary sectional view of the top plates of the covers of the printer of FIG. 4.

As illustrated in FIG. 9, when printing on a cut sheet, sheet guide 170 is pivoted upwardly causing second cover 120 to pivot therewith. Since overlap portion 190 is arranged between side plates 110*b* of first cover 110 and side plates 120*b* of second cover 120, there is no opening formed between the side plates of the first cover and those of the second cover as distinguished from the opening formed in a conventional printer (See S1 in FIG. 4). Therefore, any noise that may have leaked from the printer can be prevented, thereby also contributing to noise reduction.

Further, since the overlap portion 200, as clearly shown in FIG. 12, is provided between the top plate 110*a* of the first cover 110 and the top plate 120*a* of the second cover 120, no such opening extending along the axial line of the turning section (as is formed in the conventional printer, see S2 in FIG. 16) is formed between the top plate 110*a* of the first cover 110 and the top plate 120*a* of the second cover 120. Therefore, leakage of noise from the printer can be prevented, thereby contributing to noise reduction.

Further, sheet guide plates 123 are designed to be higher than reflecting plates 122 relative to the top plates of second cover 120. The distance between each successive sheet guide plate 123 is designed to be less than the width of the smallest sheet size used in the printer. This design achieves smooth sheet forwarding of sheet P without the front end of the sheet jamming caused by reflecting plates 122. The distance between sheet guide plates 123 is lees at the peripheral regions 2*e* (see FIG. 8), and is selected at all positions to be less than the width of the narrowest sheets of paper usable in the printer so that the front end corners of the sheet will not be caught up as they pass therethrough, thereby ensuring that the sheet will be discharged without trouble. The distance between bottom ends 122*a* of reflecting plates 122 and sheet guide 170 can be made small, thereby contributing to effective silencing. In other words, the reflecting plates can be made high since there is no likelihood that the sheet will be jammed. Thus, the silencing effects can be improved by increasing the change in the cross-section of the sheet discharge path 180, which is a sound transmitting path.

As shown in FIG. 12, cutter 110*c* is provided at the rear edge of first cover 110. A continuous sheet can be cut by cutter 110*c* by rotating second cover 120 above first cover 110 after having printed on the continuous sheet and by picking up the front end P1 of the sheet. Front end P1 of the sheet floats up by the action of guide plate 171 of sheet guide 170, thereby facilitating the ability to pick up the sheet. Second cover 120 is rotated until top plate 120*a* thereof abuts against top plate 110*a* of first cover 110.

Figure 14:
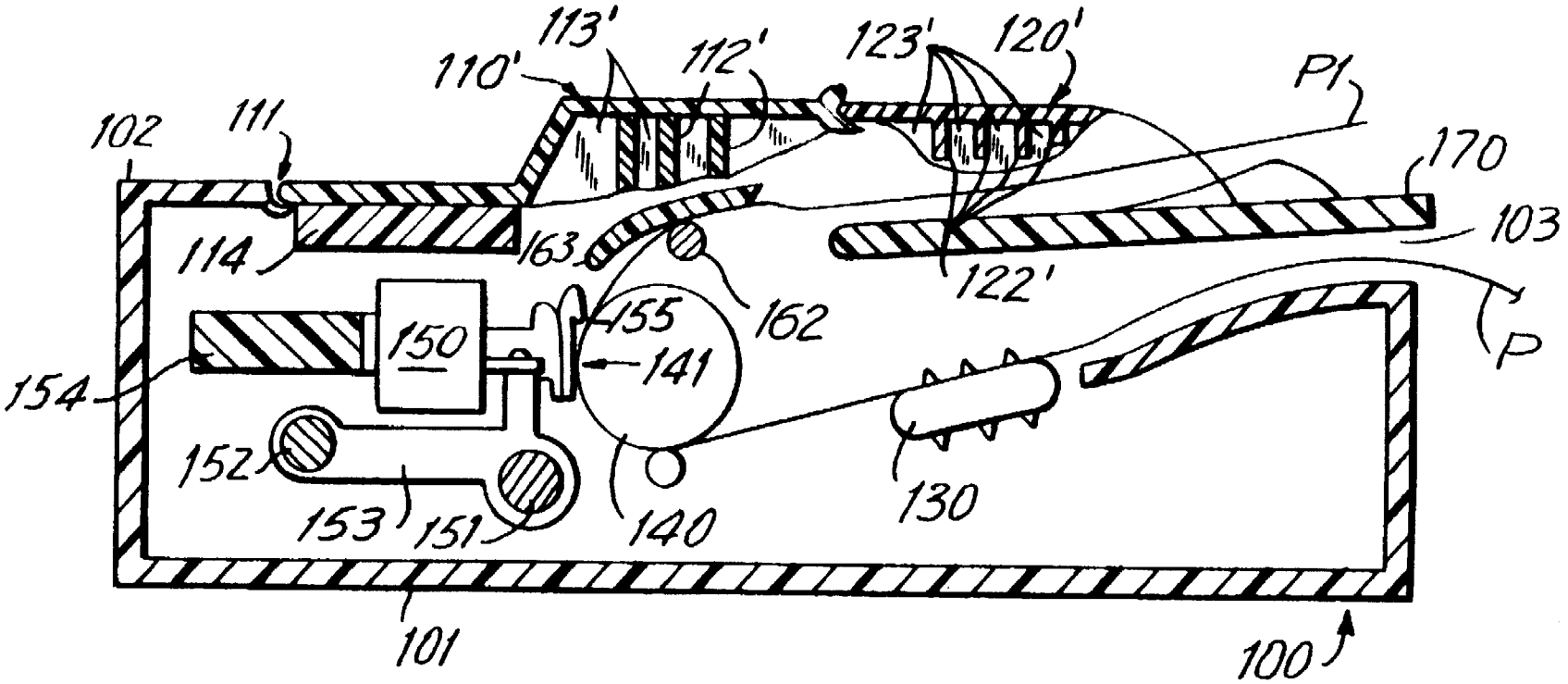
FIG. 14 is a sectional view of a printer in accordance with a second embodiment of the invention.

In accordance with a second embodiment of the invention, and as shown in FIG. 14, a sheet discharge roller 162 is made smaller in diameter than sheet discharge roller 160 in the first described embodiment. A sheet discharge plate 163 is made thinner than sheet discharge plate 161 in the above-described embodiment. As a result, the silencing means provided on first cover 110', i.e., reflecting plates 112' and sound absorbing member 114, can be located closer to print section 141.

In accordance with this second embodiment, print head 150, carriage 153, and ink ribbon cartridge 154 are mounted horizontally as shown in FIG. 14 to make the silencing means closer to print section 141. This is different than the first embodiment where print head 150, carriage 153 and ink ribbon cartridge 154 are in an inclined position.

As a result of this construction, the silencing means is located closer to print section 141, thereby improving the silencing effects.

As shown in FIG. 14, it is not essential that reinforcing plates 113' or sheet guide plates 123' be made higher than reflecting plates 112' or 122'. If sheet discharge plate 161 or 163 is arranged as in the second embodiment, the reinforcing plates 113' do not have to have the sheet guiding function unlike a third embodiments which will be described below. This makes the silencing means even closer to the print section 141.

Furthermore, an ink ribbon guide 155 guides an ink ribbon (not shown) supplied from ink ribbon cartridge 154 to the gap between print head 150 and sheet P.

Figure 15:
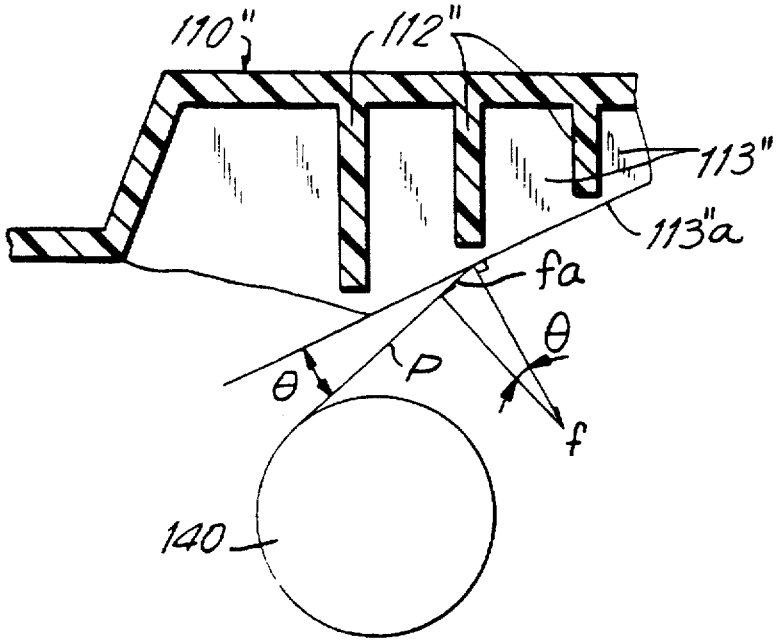
FIG. 15 is an enlarged fragmentary sectional view showing a third embodiment.

In accordance with a third embodiment, and as shown in FIG. 15, sheet discharge plate 163 is removed. As a result of this construction, the silencing means can be placed even closer to platen 140 and print head 150, thereby contributing to effective silencing.

Reinforcing plates 113" are made higher than the reflecting plates 112" to give reinforcing plates 113 the role as sheet guide plates.

This embodiment cannot be implemented on the conventional printer (FIG. 3). Since reflecting plates 12*a* are as high as sheet guide plates 12*b* in the conventional printer, the front end of the sheet after having been printed gets jammed by reflecting plates 12*a* if reflecting plates 12*a* and sheet guide plates 12*b* are arranged on second cover 12. Therefore, the silencing means cannot be located close to the platen and the print head in the conventional printer, thereby not allowing for effective silencing to be achieved.

In FIG. 15, angle θ is the angle at which sheet P sent out from platen 140 comes in contact with a sheet guide surface 113"*a* of reinforcing plate 113". This angle is set to the smallest possible value. When sheet P comes in contact with sheet guide surface 113"*a* of reinforcing plate 113, sheet P receives a reaction force f in the direction at a right angle to sheet guide surface 113"*a*. As a result, a force equal to $fa=f\times\sin\theta$, acts on sheet P for pushing the sheet P back in the direction towards platen 140. Since the angle of contact θ between sheet P and sheet guide surface 113*a* is set to a small value, the force fa for pushing the sheet back becomes small. Therefore, sheet P is guided by sheet guide surface 113*a* smoothly. Since the distance between platen 140 and sheet guide surface 113"*a* is small, the quantity fa is small, and therefore sheet P is not easily deformed, thereby allowing even very thin sheets of paper to be discharged without jamming or tearing. Since reinforcing plate 113" projects further below than reflecting plate 112", the front end of the sheet does not get jammed with reflecting plate 112" even if the front end is deformed by contact with sheet guide surface 113"*a*, thus allowing sheets to be discharged properly.

In this embodiment, the distance between reinforcing plates 113 serving as sheet guide plates is designed to be smaller than the width of the smallest sheet of paper to be fed for printing, as shown in FIG. 8 where portion 2*e* through which the front end corner of the sheet passes, is made even narrower than the distance between reinforcing plates 113 towards the middle of the printer.

Figure 16:
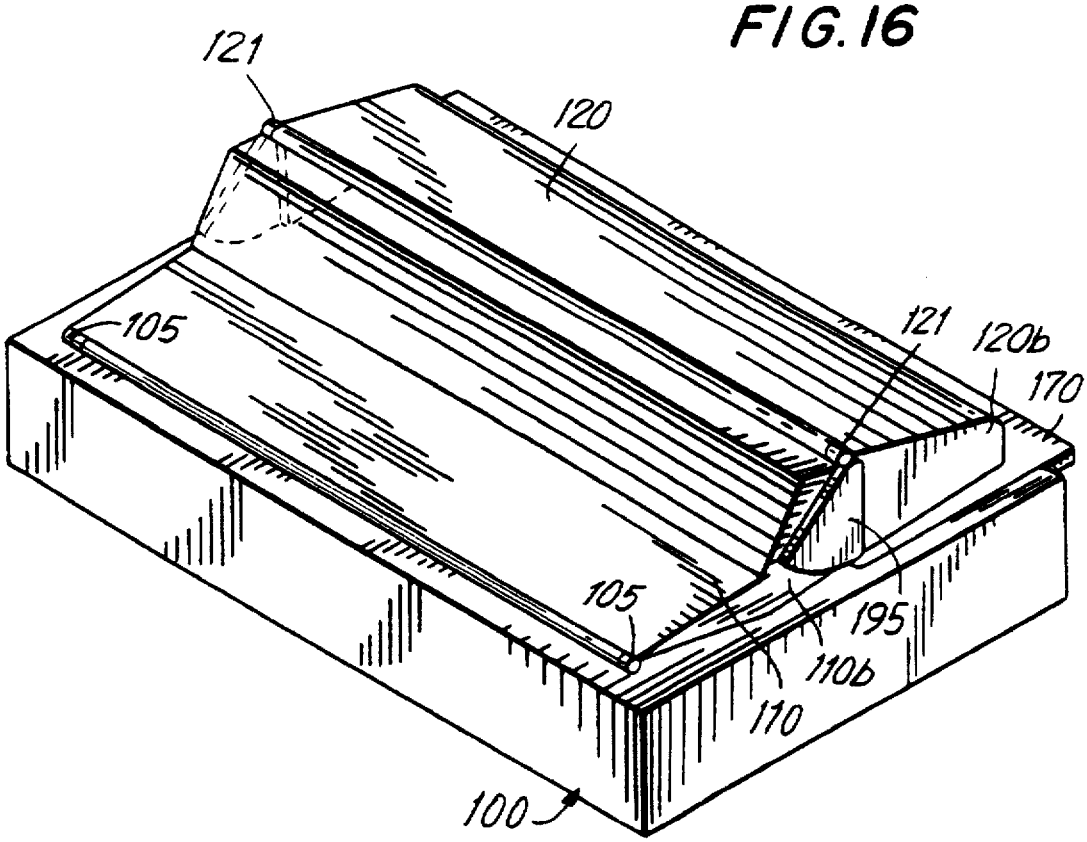
FIG. 16 is a perspective view showing the external appearance of a printer in accordance with a fourth embodiment of the present invention.

In accordance with a fourth embodiment of the invention, and as shown in FIG. 16, an overlap portion 195 arranged between side plate 110*b* of first cover 110 and side plate 120*b* of second cover 120 may be formed by a fan-like overlap strip 195 formed integrally with the outer side of the front end of side plate 120*b* of second cover 120 upon the outer side of rear end of side plate 110*b* of first cover 110.

In FIG. 16, reference numeral 105 designates a pivot support section so that the first cover 110 can pivotably be supported by printer case 100.

It will thus be seen that the objects set forth above, among those made apparent from the preceding description, are efficiently attained and, since certain changes may be made in the above constructions without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An impact dot printer comprising:

a case having at least one opening;

a print section positioned in said case at least in part in registration with said at least one opening, and having a platen and a print head, said print head confronting said platen;

a cover positioned to close at least the portion of said at least one opening in registration with and overlying said print section;

a silencing device disposed between a portion of said cover overlying at least a part of said print section and said print section constructed to reduce the sound of printing from the print section reaching the exterior of said case and cover, said silencing device including at least one reflecting plate for reflecting a sound wave; and a sheet discharge plate positioned entirely within said case and intermediate said print section and said silencing device to at least in part guide a sheet of paper in a direction away from said silencing device.

2. The impact dot printer as claimed in claim 1, and including a sheet guide defining a printed sheet conveying direction from said print section to the exterior of said case and cover, said at least one reflecting plate projecting in a direction away from said cover toward said print section and also extending in a direction substantially orthogonal to said printed sheet conveying direction.

3. The impact dot printer as claimed in claim 2, wherein said silencing device includes:

at least one reinforcing plate for in part guiding a printed sheet in said sheet conveying direction, said at least one reinforcing plate being a plate-like body projecting in said direction away from said cover and intersecting said at least one reflecting plate.

4. The impact dot printer as claimed in claim 3, wherein paper to be printed is provided with a minimum width, and including at least two adjacent reinforcing plates, the distance between said two adjacent reinforcing plates being less than said minimum width of said paper so that said at least two adjacent reinforcing plates are essentially able to simultaneously be in contact with said paper as said paper passes in said sheet conveying direction.

5. The impact dot printer as claimed in claim 2, wherein paper to be printed is provided with a minimum width, and including a plurality of reinforcing plates, the distance between any two of said reinforcing plates being less than said minimum width of said paper to be printed.

6. The impact dot printer as claimed in claim 3, wherein said silencing device is carried by said cover.

7. The impact dot printer as claimed in claim 6, and including a plurality of said reflecting plates spaced along said printed sheet conveying direction, said at least one reinforcing plate intersecting each of said reflecting plates.

8. The impact dot printer as claimed in claim 1, wherein said silencing device includes a sound absorbing member for absorbing sound, said sound absorbing member being selected from the group consisting of foam plastic and rubber.

9. The impact dot printer as claimed in claim 1, said sheet discharge plate further guiding a printed sheet disposed between said platen and said silencing device.

10. The impact dot printer as claimed in claim 2, wherein said at least one reflecting plate projects toward said platen at a point between said sheet guide and the location on said platen where said print head confronts said platen.

11. An impact dot printer comprising:

a case having at least one opening;

a print section positioned in said case at least in part in registration with said at least one opening, and having a platen and a print head, said print head confronting said platen;

a cover positioned to close at least the portion of said at least one opening in registration with said print section;

said cover including a first cover portion for covering a portion of said at least one opening of said case, said first cover portion having a top plate and at least one side plate formed integrally with said top plate; and a second cover portion pivotally mounted on said first cover portion, said second cover portion having a top plate and at least one side plate formed integrally with said top plate;

said at least one side plate of said first cover portion and said at least one side plate of said second cover portion being shaped so that one of said side plates overlies the other of said plates so that essentially no opening is formed between said at least one side plate of said first cover portion and said at least one side plate of said second cover portion when said second cover portion is pivoted relative to said first cover portion.

12. The impact dot printer as claimed in claim 11, wherein at least one of said side plates of said first and second cover portions is formed with a fan-like overlap strip on an end thereof, so as to overlap said at least one side plate of said other of said first and second cover portions.

13. The impact dot printer as claimed in claim 11, and including a guide member in part defining a printed sheet discharge path from said print section to an exterior of said case and cover, both said first cover portion and said second cover portion cooperating with the guide member in defining said printed sheet discharge path.

14. The impact dot printer as claimed in claim 11, and including a sheet discharge plate defining a printed sheet conveying direction from said print section to the exterior of said case and cover, and wherein paper to be printed is provided with a minimum width, said second cover portion being formed with at least one reflecting plate projecting in a direction away from said second cover portion for reflecting a sound wave from said print section, said at least one reflecting plate also extending in a direction orthogonal to said printed sheet conveying direction; and a plurality of sheet guide plates projecting in said direction away from said second cover portion for guiding a printed sheet, each of said sheet guide plates intersecting said at least one reflecting plate;

the distance between each pair of adjacent sheet guide plates being smaller than said minimum width of said paper to be printed.

15. An impact dot printer comprising:

a case having at least one opening;

a print section positioned in said case at least in part in registration with said at least one opening and having a platen and a print head, said print head confronting said platen;

said platen and said print head and said at least one opening defining a sheet discharge path beginning at a point of contact between said platen and said print head and extending to said at least one opening;

a cover positioned to close at least the portion of said at least one opening in registration with said print section;

said cover including a first cover portion for covering a portion of said at least one opening in said case, said first cover portion having a top plate having a front end and a rear end opposed to said front end;

a second cover portion having a top plate having a front end adjacent the rear end of said top plate of said first cover portion, said second cover portion being pivotally mounted on said first cover portion along an axial line located essentially at one of said rear end of said first cover portion top plate and said front end of said second cover portion top plate and along the sheet discharge path; and said rear end of said first cover portion top plate and said front end of said second cover portion top plate being shaped to define respective overlap portions between said top plate of said first cover portion and said top plate of said second cover portion so that essentially no opening is formed between said first cover portion and said second cover portion along said axial line as viewed in a plan view of said top plates of said first and second cover portions, when said second cover portion is pivoted relative to said first cover portion and wherein said overlap portion of said first cover portion extends at least in part into said case.

16. The impact dot printer as claimed in claim 15, wherein one of said overlap portions is formed by shaping one of the front end of said first cover portion top plate and the rear end of said second cover portion top plate as an arcuate surface corresponding to a locus formed by rotating the other of said front end of said first cover portion top plate and said rear end of said second cover portion top plate.

17. The impact dot printer as claimed in claim 15, wherein said second cover portion is positioned so as to be pivotable in a direction away from said case relative to said first cover portion, a tear bar positioned on an edge of said first cover portion exposed when said second cover portion is pivoted above the first cover portion and permitting a length of paper to be separated when drawn across said tear bar.

18. The impact dot printer as claimed in claim 15, and including a sheet discharge plate in part defining a printed sheet discharge path from said print section to the exterior of said case and cover, both said first cover portion and said second cover portion cooperating with said sheet discharge plate in defining said printed sheet discharge path.

19. The impact dot printer as claimed in claim 15, wherein said first cover portion is formed with a side plate formed integrally with said top plate; said second cover portion is formed with a side plate formed integrally with said top plate; said at least one side plate of said first cover portion and said at least one side plate of said second cover portion being shaped so that one of said side plates overlies the other of said side plates so that essentially no opening is formed between said at least one side plate of said first cover portion and said at least one side plate said second cover portion when said second cover portion is pivoted relative to said first cover portion.

20. The impact dot printer as claimed in claim 19, wherein at least one of said side plates of said first and second cover portions is formed with a fan-like overlap strip on an end thereof, so as to overlap said at least one side plate of said other of said first and second cover portions.

21. The impact dot printer as claimed in claim 15, wherein said overlap portion of said first cover portion extends at least in part into said case.

22. An impact dot printer comprising:

a case having at least one opening;

a print section positioned in said case at least in part in registration with said at least one opening, and having a platen and a print head, said print head confronting said platen;

a cover positioned to close at least the portion of said at least one opening in registration with and overlying said platen and said print head;

a silencing device disposed between a portion of said cover and said print section and overlying at least one of said platen and said print head and constructed to reduce the sound of printing from the print section from reaching the exterior of said case and cover; and a sheet discharge plate positioned intermediate at least a portion of at least one of said print head and said platen and said silencing device to at least in part deflect a sheet of paper in a direction away from said silencing device.

23. An impact dot printer comprising:

a case having at least one opening;

a print section positioned in said case at least in part in registration with said at least one opening, and having a platen and a print head, said print head confronting said platen;

a cover positioned to close at least the portion of said at least one opening in registration with and overlying said print section;

a silencing device disposed between a portion of said cover overlying at least a part of said print section and said print section constructed to reduce the sound of printing from the print section reaching the exterior of said case and cover, said silencing device including a sound absorbing member for absorbing sound, said sound absorbing member being selected from the group consisting of foam plastic and rubber; and a sheet discharge plate positioned entirely within said case and intermediate said print section and said silencing device to at least in part guide a sheet of paper in a direction away from said silencing device.

* * * * *